United States Patent [19]

Brunn

[11] Patent Number: 4,679,218

[45] Date of Patent: Jul. 7, 1987

[54] X-RAY DIAGNOSTIC INSTALLATION HAVING A CONTROL SYSTEM FOR THE X-RAY TUBE HIGH VOLTAGE

[75] Inventor: Klaus Brunn, Erlangen, Fed. Rep. of Germany

[73] Assignee: Siemens Aktiengesellschaft, Berlin and Munich, Fed. Rep. of Germany

[21] Appl. No.: 748,235

[22] Filed: Jun. 24, 1985

[30] Foreign Application Priority Data

Jun. 29, 1984 [DE] Fed. Rep. of Germany ..... 3424055

[51] Int. Cl.[4] ..... H05G 1/10

[52] U.S. Cl. ..... 378/101; 378/111; 378/114

[58] Field of Search ..... 378/101, 114, 115, 108, 378/111, 112, 16

[56] References Cited

U.S. PATENT DOCUMENTS

| | | | |
|---|---|---|---|
| 3,631,434 | 12/1971 | Schwartz | 250/342 |
| 3,703,718 | 11/1972 | Berman | 250/342 |
| 3,765,539 | 10/1973 | Bradshaw et al. | 340/567 |
| 3,894,235 | 7/1975 | Franke | 378/108 |
| 4,309,612 | 1/1982 | Aichinger | 378/108 |
| 4,321,594 | 3/1982 | Galvin et al. | 340/567 |
| 4,429,224 | 1/1984 | Wägli et al. | 250/342 |

FOREIGN PATENT DOCUMENTS

| | | | |
|---|---|---|---|
| 0050751 | 10/1981 | European Pat. Off. . | |
| 3014879 | 1/1982 | Fed. Rep. of Germany . | |
| 2481045 | 8/1981 | France | 378/108 |

*Primary Examiner*—Janice A. Howell

*Attorney, Agent, or Firm*—Hill, Van Santen, Steadman & Simpson

[57] ABSTRACT

A control system for the x-ray tube high voltage supply in an x-ray diagnostic installation has a switching device for switching between two circuits for providing an actual value to the high voltage generator for regulating the output thereof. The first circuit determines an actual value from a voltage divider connected to two high voltage generators in series. The other circuit includes radiation detectors, one of which may be filtered, which provide an indication of the radiation quality and are used to modulate an incoming actual value signal. Operation of the switching device is controlled by a ramp generator such that in the range of lower x-ray tube high voltages, which occur immediately after switching on the x-ray tube, control is undertaken on the basis of the actual value of the x-ray tube high voltage through the voltage divider, and upon the attainment of a higher x-ray tube high voltage a switch over occurs such that control of the high voltage is effected by the radiation-detecting circuit.

10 Claims, 1 Drawing Figure

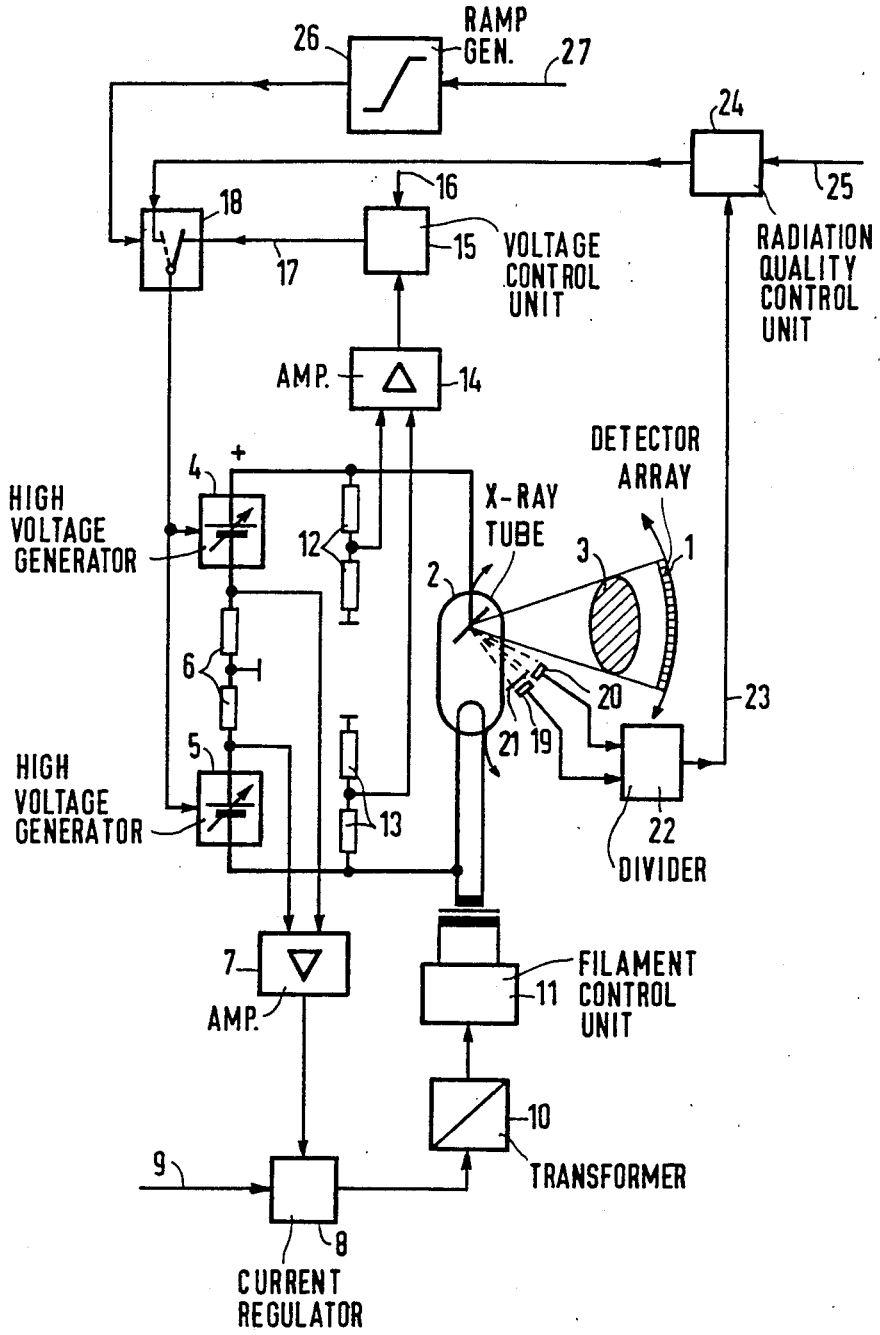
RAMP GEN.
26
27
24
25
RADIATION QUALITY CONTROL UNIT
18
16
15
17
VOLTAGE CONTROL UNIT
AMP.
14
DETECTOR ARRAY
4
+
HIGH VOLTAGE GENERATOR
12
X-RAY TUBE
3
1
2
6
20
23
5
21
19
HIGH VOLTAGE GENERATOR
13
22
DIVIDER
7
AMP.
FILAMENT CONTROL UNIT
11
10
TRANSFORMER
9
8
CURRENT REGULATOR

X-RAY DIAGNOSTIC INSTALLATION HAVING A CONTROL SYSTEM FOR THE X-RAY TUBE HIGH VOLTAGE

BACKGROUND OF THE INVENTION

1. Field of the Invention

The present invention relates to x-ray diagnostic installations, and in particular to a control system for the x-ray tube high voltage thereof.

2. Description of the Prior Art

Conventional x-ray diagnostic installations are known wherein the actual value signal for the x-ray tube high voltage control is formed by detecting the radiation quality by means of detectors disposed in the path of the radiation. Because this radiation quality is the particular value which is to be maintained constant, it must be optimally set in such an x-ray diagnostic installation. Because more than one detector is needed, the outputs of the individual radiation detectors are supplied to a divider unit, which in turn generates a control signal which is further processed. A problem in control of x-ray diagnostic installations in this manner, however, is that known divider units, particularly in the region of lower x-ray tube high voltages such as occur immediately after the x-ray tube is switched on, does not provide any informational signal, so that an unfocused search for the optimum value occurs.

SUMMARY OF THE INVENTION

It is an object of the present invention to provide an x-ray diagnostic installation having a reliable control system which is operable in a known manner even in the range of lower x-ray tube high voltages.

The above object is inventively achieved in a control system for an x-ray tube high voltage generator in an x-ray diagnostic installation wherein a voltage divider is utilized as a second actual value transmitter for the x-ray tube high voltage. Changeover between the voltage divider control circuit and the radiation-detector control circuit is undertaken by means of a switching device such that during an initial portion of the operation of the installation, such as immediately after start-up of the x-ray tube, control is undertaken by the voltage divider circuit, and a switch over occurs after a period of time transfering control to the radiation-detector circuit. Such switch over may be controlled by a ramp generator which supplies a control signal in the form of a ramp to the switching device based on an incoming nominal signal.

DESCRIPTION OF THE DRAWING

The single FIGURE is a schematic circuit diagram of an x-ray diagnostic installation with a high voltage control system constructed in accordance with the principles of the present invention.

DESCRIPTION OF THE PREFERRED EMBODIMENTS

The x-ray diagnostic installation shown in the drawing is in the form of a computer tomography apparatus having a detector array 1 and an x-ray tube 2 rotatable in combination around a patient 3, as indicated by the curved arrows. The patient is thereby irradiated from different directions, so that a cross-sectional image of the patient 3 can be derived from the output signals of the detector array 1 in a known manner.

The x-ray tube 2 is supplied with high voltage by two series-connected high voltage generators 4 and 5. The high voltage generators 4 and 5 are interconnected by two resistors 6, having a common tap connected to ground. At the opposite terminals of the resistors 6, a signal corresponding to the x-ray tube current is tapped which, after amplification in an amplifier 7, is supplied to an x-ray tube current regulator 8. The x-ray tube current regulator 8 receives a signal on line 9 corresponding to the nominal value of the x-ray tube current and, through a transformer 10, operates a filament control element 11 in the filament circuit for the x-ray tube 2 for the purpose of approximating the actual value of the x-ray tube current to the nominal value on line 9.

For controlling the x-ray tube high voltage, two voltage dividers 12 and 13 are provided at which a signal corresponding to the x-ray tube high voltage is tapped. This signal is amplified in an amplifier 14, and supplied to a voltage control unit 15. The voltage control unit 15 receives a nominal voltage value on line 16 for the x-ray tube high voltage. The voltage control unit 15 supplies a signal on line 17 to a switching device 18. The switching device 18 can assume two positions, in the position shown in the drawing in the unbroken line the switching device 18 connects the voltage divider circuit (consisting of components 12, 13, 14 and 15) into the circuit for controlling the high voltage generators 4 and 5. The x-ray tube high voltage is thus controlled to approximate the nominal value.

For detecting the radiation quality, two radiation detectors 19 and 20 are provided in the radiation field, the radiation detector 19 being covered by a radiation filter 21. The output signals from the radiation detectors 19 and 20 are supplied to a divider 22. The divider 22, which may be a device constructed and operating in accordance with the teachings of German OS 30 14 879, generates a signal on line 23 corresponding to the actual value of the radiation quality. This signal operates a control unit 24 which receives a radiation quality nominal value signal on line 25, for the purpose controlling the high voltage generators 4 and 5 so as to generate a voltage for operating the x-ray tube which maintains the actual radiation quality at an approximation of the nominal radiation quality value. The radiation-detector circuit (consisting of components 19, 20, 21, 22 and 24) is connected in the circuit for controlling the high voltage generators 4 and 5 when the switching device 18 is in the state indicated by the dashed line.

Changeover of the switching device 18 between the positions indicated respectively by the unbroken line and the dash line is undertaken by a ramp generator 26. The ramp generator 26 receives an input signal on line 27 indicating the beginning and duration of a radiation examination. The signal on line 27 may, for example, be proportional to the voltage, and will thus increase over time during the start-up of the installation, or may be strictly a signal indicating the amount of elapsed time after the installation is switched on. In any event, the ramp generator 26 generates a ramp output of increasing magnitude to the switching device 18. The switching device 18 includes a threshold circuit of any conventional construction which causes the switch therein to change state upon the attainment of a selected voltage threshold by the ramp signal. The preferred manner of operation is that under the control of the signal from the ramp generator 26, the switching device 18 connects the voltage divider circuit to the high voltage generators 4 and 5 during an initial phase of the radiation examination, wherein the x-ray tube high voltage is in a lower range immediately after start-up, and during which time the divider 22 cannot properly generate an output signal. After the examination has proceeded for a short time, and the x-ray tube high voltage is in a higher range, the ramp generator 26 causes the switching device 18 to switch over to permit control of the high voltage generators 4 and 5 by the radiation-detector circuit through the divider 22 and the control unit 24.

In the illustrated sample embodiment, only the radiation detector 19 is covered by a filter 21. The radiation incident on the respective detectors 19 and 20 is accordingly attenuated in different amounts, the radiation detector 20 is attenuated by air only, and the radiation detector 19 is of course attenuated by the filter 21. Two filters of different material may also be utilized instead of the single filter 21.

Although modifications and changes may be suggested by those skilled in the art it is the intention of the inventor to embody within the patent warranted hereon all changes and modificatons as reasonably and properly come within the scope of his contribution to the art.

I claim as my invention:

1. A control system for a variable means for generating high voltage for operating an x-ray tube generating an x-ray field in an x-ray diagnostic installation comprising:

first control means connected to the output of said means for generating high voltage for generating a control signal proportional to the actual voltage output thereof;

second control means including at least two radiation detectors disposed in said x-ray field, a divider connected to the outputs of said radiation detectors for generating a signal proportional to the radiation quality detected, and a radiation quality control unit connected to an output of said divider, said radiation quality control unit having an input for receiving a nominal radiation quality value, and said radiation quality control unit generating a control signal for varying said means for generating high voltage for matching the actual radiation quality detected by said detectors to said nominal radiation quality value;

means for switching connected to each of said first and second control means and to said means for generating high voltage for through-connecting one of said first or second control means to said means for generating high voltage for varying said means for generating high voltage in accordance with the control signal therefrom; and switch control means for changing the state of said means for switching at a selected time after start-up of said installation.

2. A control system as claimed in claim 1 wherein said first control means comprises:

a voltage divider connected to the output of said means for generating high voltage; and a voltage control unit connected between said voltage divider and said means for switching, said voltage control unit having an input for receiving a nominal voltage value and said voltage control unit generating a control signal for approximately matching the output of said means for generating high voltage to said nominal voltage signal.

3. A control system as claimed in claim 1 wherein said switch control means is a ramp generator.

4. A control system as claimed in claim 3 wherein said ramp generator has an input for receiving a signal beginning at the time of start-up of said installation, and wherein said ramp signal operates said means for switching for initially connecting said first control means to said high voltage generator and after a selected period of time changing the state of said means for switching to connect said second control means to said means for generating high voltage.

5. An x-ray diagnostic installation comprising:

an x-ray tube for generating a radiation field for irradiating a patient;

at least one high voltage generator for supplying high voltage for operating said x-ray tube;

a voltage divider connected to an output of said high voltage generator for generating a signal proportional to the voltage output thereof;

a voltage control unit connected to said voltage divider and having an input for receipt of a nominal voltage value, said voltage control unit having an output at which a control signal is generated for matching the signal received from said voltage divider to said nominal voltage value;

two radiation detectors disposed in said radiation field for detecting the radiation quality;

a divider unit connected to said radiation detectors for generating a signal proportional to the radiation quality detected;

a radiation quality control unit connected to an output of said divider unit and having an input for receipt of a nominal radiation quality value, said radiation quality control unit having an output at which a control signal is generated for matching the actual radiation quality detected by said detectors to said nominal radiation quality value;

a switch connected between said voltage control unit and said radiation quality control unit for connecting one of those units to said high voltage generator for varying the voltage output thereof; and means for changing the state of said switch for selectively connecting one of said voltage control unit or said radiation quality control unit to said high voltage generator at a selected time during operation of said installation.

6. An installation as claimed in claim 5 wherein said means for changing the state of said switch is a ramp generator.

7. An installation as claimed in claim 5 further comprising a filter disposed in front of at least one of said radiation detectors.

8. An installation as claimed in claim 5 further comprising:

a further high voltage generator connected in series with said high voltage generator and to said x-ray tube for supplying high voltage thereto; and a further voltage divider connected between the output of said further high voltage generator and said voltage control unit.

9. An installation as claimed in claim 8 further comprising an amplifier having inputs respectively connected to said voltage divider and to said further voltage divider, and having an output connected to said voltage control unit.

10. A method for operating an x-ray diagnostic installation having an x-ray tube for generating a radiation field and a high voltage generator for supplying high voltage to said x-ray tube comprising the steps of:

generating a signal proportional to the actual voltage output of said high voltage generator;

generating a control signal for matching said actual voltage to a nominal voltage value;

generating a signal proportional to the radiation quality of the radiation from said x-ray tube by at least one detector disposed in said radiation field;

generating a further control signal for matching the actual radiation quality signal to a nominal radiation quality value; and controlling said high voltage generator by said control signal during an initial phase of operation of said installation immediately after start-up thereof and controlling operation of said high voltage generator by said further control signal beginning at a selected time following start-up of said installation.

* * * * *